US008016564B1

(12) United States Patent
Liang

(10) Patent No.: US 8,016,564 B1
(45) Date of Patent: Sep. 13, 2011

(54) TURBINE BLADE WITH LEADING EDGE IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 419 days.

(21) Appl. No.: 12/421,134

(22) Filed: Apr. 9, 2009

(51) Int. Cl.
*F01D 5/08* (2006.01)
*F01D 5/20* (2006.01)

(52) U.S. Cl. ..... 416/97 R; 415/115; 416/1; 416/92; 416/96 R; 416/97 A

(58) Field of Classification Search ..... 415/115; 416/1, 92, 96 R, 97 A, 97 R
See application file for complete search history.

(56) References Cited

U.S. PATENT DOCUMENTS 6,491,496 B2 * 12/2002 Starkweather ..... 416/97 R
7,547,190 B1 * 6/2009 Liang ..... 416/97 R
7,704,046 B1 * 4/2010 Liang ..... 416/96 R

* cited by examiner

*Primary Examiner* — Asok Sarkar
(74) *Attorney, Agent, or Firm* — John Ryznic

(57) ABSTRACT

A turbine rotor blade with a low cooling flow serpentine circuit to provides cooling for the airfoil. The circuit includes a first 3-pass serpentine flow circuit with a first leg located adjacent to the leading edge to provide impingement cooling air into a leading edge impingement cavity. The remaining cooling air flows through the first serpentine circuit to provide cooling for the blade forward mid-chord region and is discharged through film cooling holes on the pressure and suction side walls. Some of the impingement cooling air for the leading edge is discharged as film cooling air for the leading edge surface while the remaining spent cooling air flows through a blade tip channel and then into the second aft flowing 3-pass serpentine circuit to provide impingement cooling for the trailing edge region before being discharged out through exit slots and blade tip corner discharge holes.

16 Claims, 4 Drawing Sheets

View A-A

TURBINE BLADE WITH LEADING EDGE IMPINGEMENT COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with enhanced leading edge impingement cooling.

2. Description of the Related Art Including Information Disclosed Under 37 CFR 1.97 and 1.98

A gas turbine engine includes a turbine with multiple rows or stages of rotor blades that react with a high temperature gas flow to drive the engine or, in the case of an industrial gas turbine (IGT), drive an electric generator and produce electric power. It is well known that the efficiency of the engine can be increased by passing a higher temperature gas flow into the turbine. However, the turbine inlet temperature is limited to the material properties of the first stage vanes and blades and the amount of cooling that can be achieved for these airfoils.

In latter stages of the turbine, the gas flow temperature is lower and thus the airfoils do not require as much cooling flow. In future engines, especially IGT engines, the turbine inlet temperature will increase and result in the latter stage airfoils to be exposed to higher temperatures. To improve efficiency of the engine, low cooling flow airfoils are being studied that will use less cooling air while maintaining the metal temperature of the airfoils within acceptable limits. Also, as the TBC (thermal barrier coating) gets thicker, less cooling air is required to provide the same metal temperature as would be for a thicker TBC.

FIG. 1 shows an external pressure profile for a turbine rotor blade. As indicated in the figure, the forward region of the pressure side surface experiences high hot gas static pressure while the entire suction side of the airfoil is at a much lower hot gas static pressure than the pressure side. The pressure side pressure profile in the line on the top while the suction side pressure profile is the line on the bottom in the FIG. 1.

FIG. 2 shows a prior art turbine rotor blade with a (1+5+1) forward flowing serpentine cooling circuit for a first stage rotor blade. FIG. 3 shows a schematic view of the rotor blade of FIG. 2 and FIG. 4 shows a flow diagram of the flow path through the FIG. 2 rotor blade. The prior art blade cooling circuit includes a leading edge cooling supply channel 21 connected to a leading edge impingement cavity 23 by a row of metering and impingement holes 25, and where the impingement cavity 23 is connected to a showerhead arrangement of film cooling holes 26 and gills holes 24 on both sides to discharge a layer of film cooling air onto the leading edge surface of the airfoil. A forward flowing 5-pass serpentine cooling circuit is used in the airfoil mid-chord region with a first leg 11 for supplying cooling air located adjacent to the trailing edge region of the airfoil. The second leg 12, third leg 13, fourth leg 14 and fifth leg 15 of the serpentine flow toward the leading edge in series with rows of film cooling holes 17 connected to some of the 5 legs to discharge film cooling air onto the pressure or suction sides of the airfoil. A trailing edge cooling air supply channel 31 supplies cooling air for the trailing edge region and is connected to a series of impingement holes 32 and 34 to first and second impingement cavities 33 and 35, which is connected to a row of exit holes or slots 36 to discharge the spent impingement cooling air. Film cooling holes 37 can also be connected to the impingement cavity 33.

The cooling air flows from the trailing edge region toward the leading edge region and discharges into the hot gas side pressure section of the pressure side of the airfoil. In order to satisfy the back flow margin criteria, a high cooling supply pressure is needed for this particular design, and thus inducing a high leakage flow. In the prior art cooling arrangement of FIG. 2, the blade tip section is cooled with double tip turns in the serpentine circuit and with local film cooling. Cooling air bled off from the 5-pass serpentine flow circuit will thus reduce the cooling performance for the serpentine flow circuit. Independent cooling flow circuit is used to provide cooling circuits from the 5-pass serpentine flow circuit is used for cooling of the airfoil leading and trailing edges.

As the TBC technology improves and more industrial turbine blades are applied with thicker or low conductivity TBC, the amount of cooling flow required for the blade will be reduced. As a result, there is not sufficient cooling flow for the prior art design with the 1+5+1 forward flowing serpentine cooling circuits of FIG. 2. Cooling flow for the blade leading edge and trailing edge has to be combined with the mid-chord flow circuit to form a single 5-pass flow circuit. However, for a single forward flow 5-pass circuit with total blade cooling flow BFM (back flow margin) may become a design problem.

BRIEF SUMMARY OF THE INVENTION

It is an object of the present invention to provide for a turbine rotor blade with a thick TBC and low cooling flow for a low gas temperature condition.

It is another object of the present invention to provide for a turbine rotor blade with enhanced leading edge impingement cooling over the cited prior art turbine rotor blade cooling design.

It is another object of the present invention to provide for a turbine rotor. blade with a minimized blade back flow margin issue.

It is another object of the present invention to provide for a turbine rotor blade with an improved use of cooling air pressure potential in a blade.

It is another object of the present invention to provide for a turbine rotor blade with a higher cooling mass flow through the blade leading edge impingement cavity.

It is another object of the present invention to provide for a turbine rotor blade without the need for blade forward section pressure side film cooling.

The above objective and more are achieved with the cooling circuit for a rotor blade of the present invention which includes two aft flowing 3-pass serpentine flow cooling circuits to provide impingement cooling for the leading edge, impingement cooling for the trailing edge region and convection cooling for the blade mid-chord region. Cooling air supplied to the first aft flowing serpentine circuit includes metering and impingement holes to provide impingement cooling against the backside surface of the leading edge. Cooling air not discharged through showerhead film cooling holes then flows under the blade tip and into second and third legs in the trailing edge region to provide impingement cooling air for the trailing edge region. Cooling air in the supply channel of the first serpentine circuit that does not pass through the metering and impingement holes flows into the second and third legs to provide cooling for the mid-chord region and is then discharged through rows of film cooling holes located in the third leg along the pressure side wall and the suction side wall.

DETAILED DESCRIPTION OF THE INVENTION

The twin 3-pass aft flowing serpentine flow cooling circuit of the present invention is intended for use in a turbine rotor blade of an IGT, but could also be used in an aero engine rotor blade. The cooling circuit provides for a dual serpentine cooling circuit with enhanced blade leading edge impingement cooling performance for a turbine rotor blade coated with TBC and at a low cooling flow rate.

Figure 5:
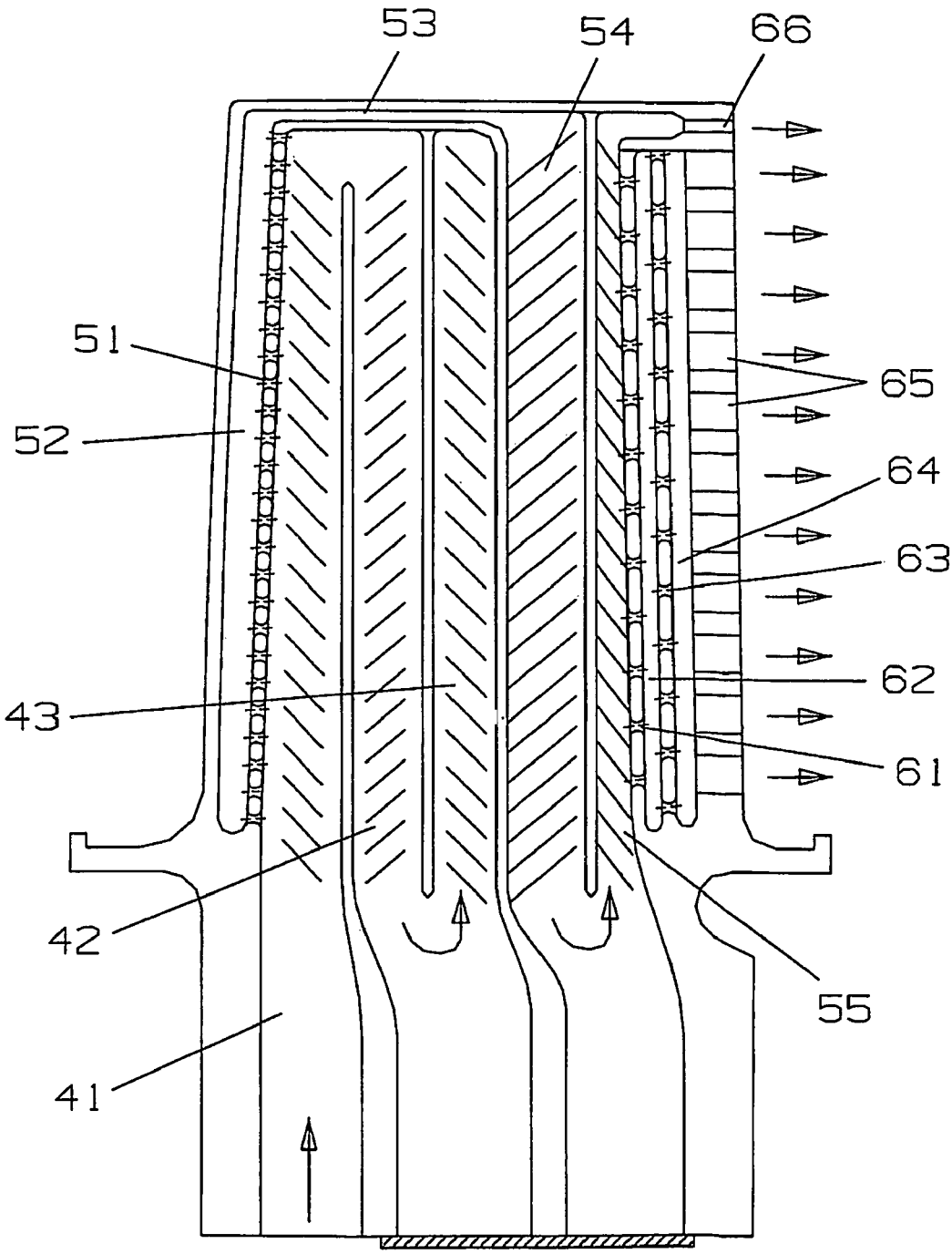
FIG. 5 shows a cross section side view of the twin aft flowing serpentine flow circuits of the present invention.

FIG. 5 shows the blade serpentine flow cooling circuit of the present invention and includes first 3-pass aft flowing serpentine flow cooling circuit with a first leg 41, a second leg 42 and a third leg 43. The first leg is supplied with pressurized cooling air through a passage in the blade root that is connected to a blade external source such as a compressor. A row of metering and impingement holes 51 connects the first leg 41 to a leading edge impingement cavity 52 located along the leading edge. a showerhead arrangement of film cooling holes 53 is connected to the leading edge impingement cavity to discharge a layer of film cooling air onto the external airfoil surface. pressure side and suction side gill holes 54 are also connected to the leading edge impingement cavity 52.

The leading edge impingement cavity 52 forms a first leg of a second 3-pass serpentine flow cooling circuit and is connected to a second leg 54 through a blade tip cooling channel 53 that runs between the blade tip and the serpentine passages underneath. A third leg 55 is connected to the second leg 54 at a root turn in the airfoil. First and second metering and impingement holes 61 and 63 with first and second impingement cavities 62 and 64 are formed within the trailing edge region to provide cooling for this section of the airfoil. A row of exit holes or slots 65 is connected to the impingement holes and cavities to discharge the spent cooling air from the trailing edge. The third leg 55 is connected to a tip corner passage and a tip corner exit hole 66 to discharge any remaining cooling air.

Figure 6:
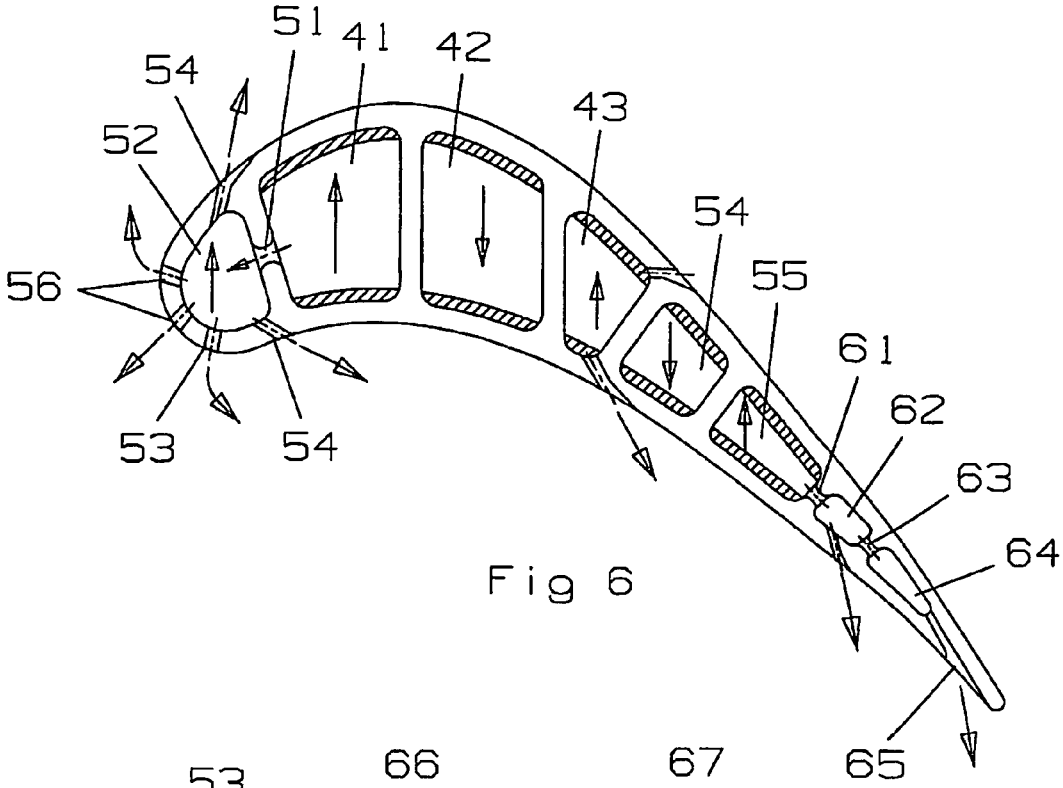
FIG. 6 shows a cross section top view of the blade cooling circuit of the present invention.

FIG. 6 shows a cross section top view of the serpentine flow cooling circuit of FIG. 5 and includes the showerhead arrangement of film cooling holes 53 on the leading edge with a stagnation film hole, a pressure side film hole and a suction side film hole. A pressure side gill hole 54 and a suction side gill hole 54 is also included. The 3-pass serpentine flow circuit with three legs 41-43 is shown in which the third leg 43 includes rows of film cooling holes on both the pressure side and suction side walls to discharge the cooling air from the third leg 43. the second 3-pass serpentine flow cooling circuit includes the first leg 52 arranged along the leading edge, and the second 54 and third legs 55 located aft of the first 3-pass serpentine flow cooling circuit and along the trailing edge region. The first impingement cavity 62 includes a row of film cooling holes on the pressure side wall. The exit slots 65 open onto the pressure side wall of the trailing edge region of the airfoil.

Figure 7:
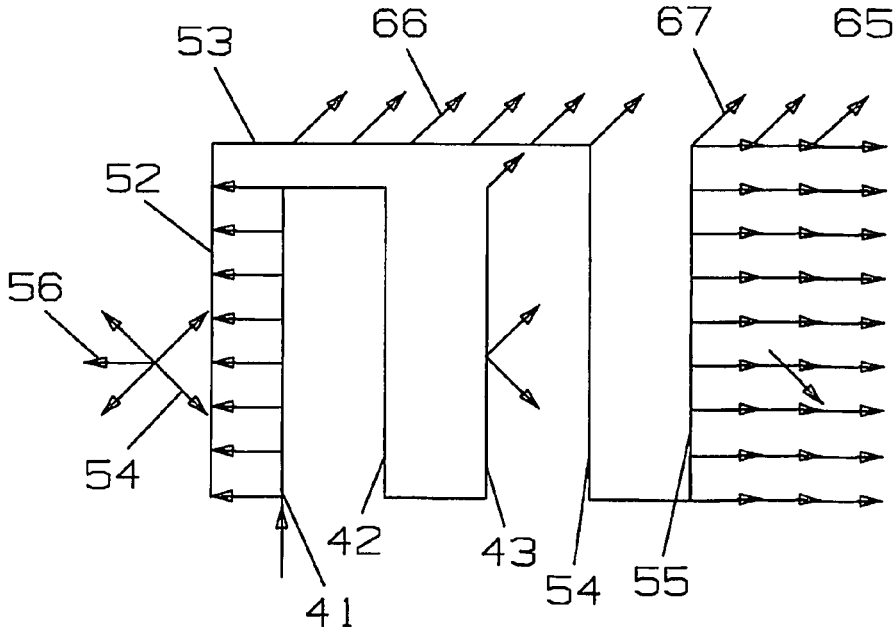
FIG. 7 shows a flow diagram of the twin 3-pass aft flowing serpentine cooling circuits of the present invention.

FIG. 7 shows a flow diagram of the cooling circuit of FIGS. 5 and 6. Pressurized cooling air is supplied to the blade through the root and passes into the first leg 41 of the 3-pass serpentine flow circuit located adjacent to the leading edge region of the blade. All of the cooling air for the entire blade passes into the first leg 41. thus, the cooling air flowing into the first leg 41 is at the highest pressure available and at the lowest temperature.

Some of the cooling air flowing through the first leg 41 bleeds off through the row of metering and impingement cooling holes 51 to provide impingement cooling to the backside surface of the leading edge wall. The'remaining cooling air not bled off through the metering and impingement holes 51 then passes into the second leg 42 and then the third leg 43 where the cooling air is discharged from the serpentine through rows of film cooling holes located on the pressure side and the suction side walls.

Some of the cooling air that flows into the leading edge impingement cavity 52 flows through the showerheads film cooling holes 56 and the gill holes 54 while the remaining spent impingement cooling air, flows up and along the blade tip channel 53 to provide cooling for the blade tip. Some of the cooling air flowing through the tip channel 53 will flow through blade tip cooling holes 66 to be discharged from the blade. The remaining cooling air from the tip channel 53 will then flow into the second leg 54 of the second 3-pass serpentine flow cooling circuit and then into the third leg 55.

Most of the cooling air that flows through the third leg 55 will be bled of through the first and second metering and impingement holes 61 and 63 and impingement cavities 62 and 64 formed within the trailing edge region of the blade and then be discharged through the row of exit slots 65. The remaining cooling air from the third leg 55 will flow into the tip corner channel and out the tip corner exit hole 66 on the trailing edge or through tip corner holes 67 on the blade tip.

With the serpentine flow cooling circuit of the present invention, the total blade cooling air is fed through the blade leading edge section first. A portion of the cooling air is then channeled through the first aft flowing serpentine flow circuit for cooling the airfoil forward section where the heat load is low. The spent cooling air is then discharged onto the airfoil through the pressure side and suction side shaped diffusion film cooling holes.

The blade leading edge, tip section and the trailing edge cooling air from the main cooling supply cavity is then impinged onto the backside surface of the airfoil leading edge wall to provide blade leading edge backside convective cooling first. A portion of the spent cooling air is then discharged through the airfoil leading edge showerhead film cooling holes as well as pressure side and suction side gill holes to form a film cooling layer for the cooling of the blade leading edge where the heat load is the highest on the entire airfoil. A portion of the spent cooling air from the leading edge impingement cavity is then channeled through the tip section and flows through the blade aft serpentine flow circuit to provide blade tip section and trailing edge cooling. With the cooling air flow management method, a majority of the blade cooling air is utilized for the blade leading edge backside surface for impingement cooling first and therefore the blade leading edge cooling performance is improved over the cited prior art circuit.

Figure 1:
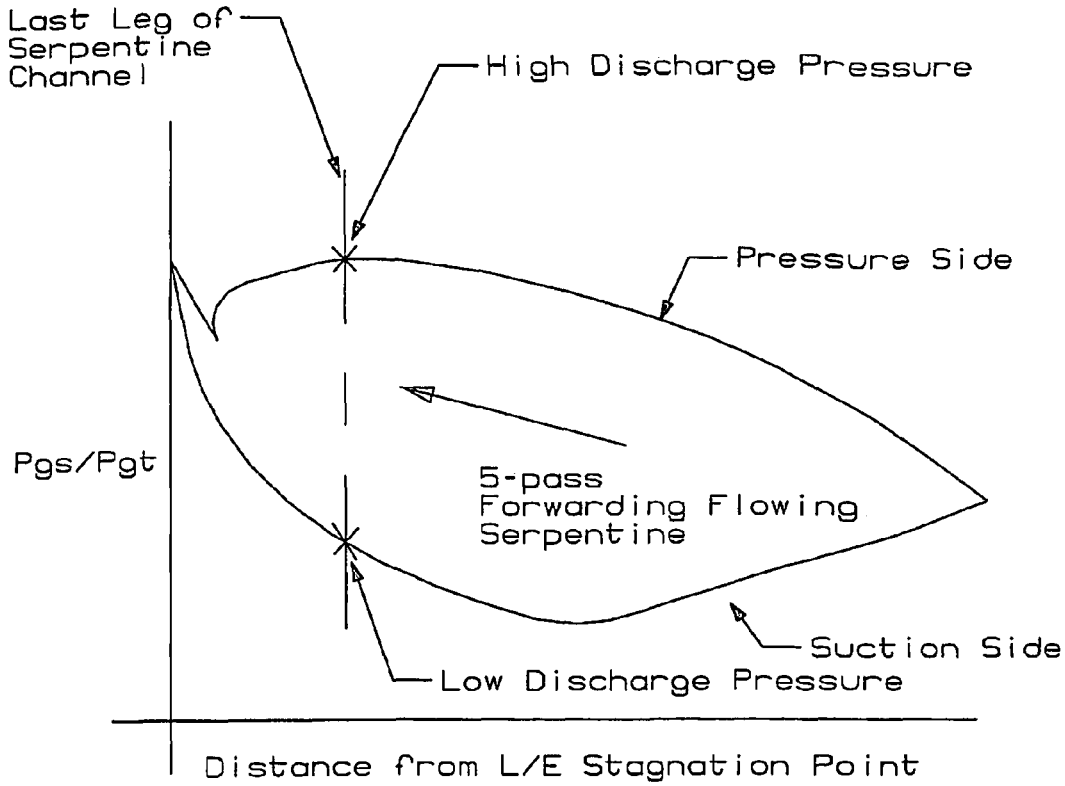
Fig 1 Prior Art
FIG. 1 shows a graph of a turbine rotor blade external pressure profile.
Figure 2:
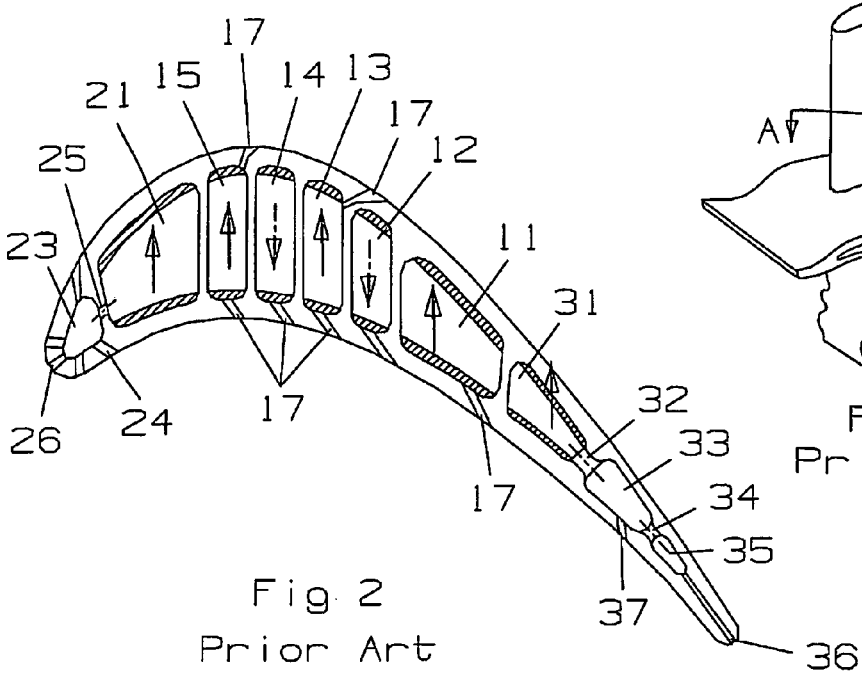
Fig 2 Prior Art
FIG. 2 shows a cross section top view of a prior art turbine rotor blade 1+5+1 forward flowing serpentine cooling circuit.
Figure 3:
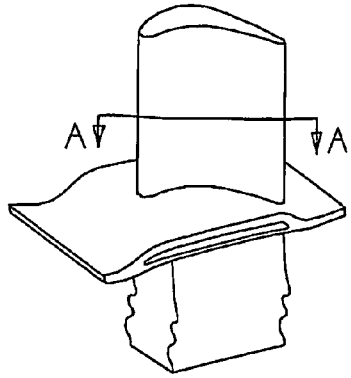
Fig 3 Prior Art
FIG. 3 shows a schematic view of the prior art turbine rotor blade.
Figure 4:
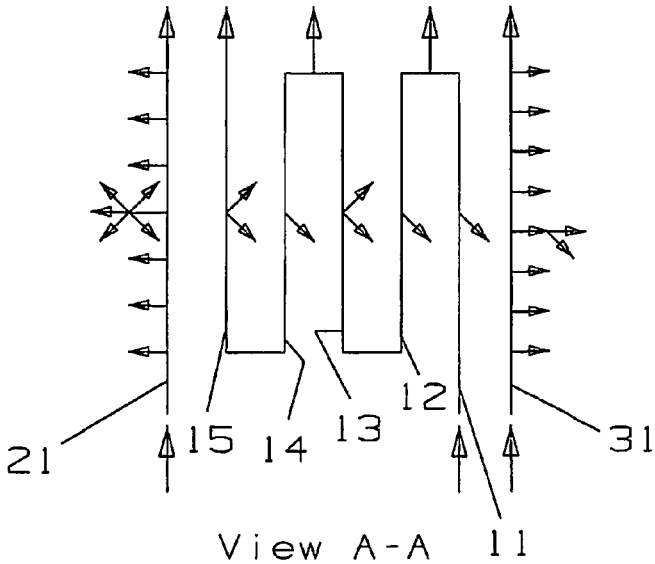
Fig 4 Prior Art
FIG. 4 shows a flow diagram of the prior art 1+5+1 serpentine flow cooling circuit of FIG. 2.

A number of major design features and advantages for the cooling circuit of the present invention over the prior art cooling circuit of FIG. 2 is described below.

The blade BFM (back flow margin) issue is minimized.

The blade total cooling air is fed through the airfoil forward section and flows toward the airfoil trailing edge to maximize the use of cooling air pressure potential.

A higher cooling mass flow through the airfoil leading edge backside impingement is achieved which yields a lower blade leading edge metal temperature and thus a higher oxidation life for the blade.

The blade total cooling flow is fed through the airfoil forward section where the external gas side heat load is low. Since the cooling air temperature is fresh, the use of cooling air potential is maximized in order to achieve a non-film cooling zone for the airfoil. Elimination of blade forward section pressure side film cooling becomes feasible.

The tip section and the trailing edge cooling flow is used for the blade leading edge backside impingement first. This doubles the use of the cooling air and will maximize the blade cooling effectiveness. Also, the combination of tip section cooling with leading edge impingement will enhance the backside impingement effectiveness as well as enlarge the impingement cross over hole size for a better blade casting yield.

Tip turns for the 3-pass serpentines creates double cooling for the blade tip section to yield a better cooling for the blade tip. Film cooling may also be used at the aft portion of the tip aft-pass serpentine flow circuit.

The concurrent aft flowing 3-pass serpentine flow cooling circuit will maximize the use of cooling air and provide a very high overall cooling efficiency for the entire airfoil.

The aft flowing serpentine flow cooling circuit used for the airfoil main body will maximize the use of cooling to mainstream gas side pressure potential. A portion of the air is discharged at the aft section of the airfoil where the gas side pressure is low to yield a high cooling air to mainstream pressure potential to be used for the serpentine channels and maximize the internal cooling performance for the serpentine.

The aft flowing main body 3-pass serpentine flow channel yields a lower cooling supply pressure requirement and a lower leakage from the blade.

I claim the following:

1. An air cooled turbine rotor blade comprising:

an airfoil having an airfoil cross sectional shape with a leading edge and a trailing edge, and a pressure side wall and a suction side wall both extending between the two edges;

a first aft flowing 3-pass serpentine flow cooling circuit with a first leg located adjacent to a leading edge region of the airfoil;

a leading edge impingement cavity located along the leading edge of the airfoil;

a row of metering and impingement holes connecting the first leg of the first aft flowing 3-pass serpentine flow cooling circuit to the leading edge impingement cavity; and, a second aft flowing 3-pass serpentine flow cooling circuit with a first leg being the leading edge impingement cavity and the second and third legs being located in the trailing edge region of the airfoil to supply cooling air to a trailing edge region cooling circuit.

2. The air cooled turbine rotor blade of claim 1, and further comprising:

a blade tip cooling channel connecting the leading edge impingement cavity to the second leg of the second aft flowing 3-pass serpentine flow cooling circuit.

3. The air cooled turbine rotor blade of claim 1, and further comprising:

showerhead arrangement of film cooling holes connected to the leading edge impingement cavity.

4. The air cooled turbine rotor blade of claim 1, and further comprising:

the first and second aft flowing 3-pass serpentine flow cooling circuits both include first, second and third legs that extend from a platform region of the blade to the blade tip section.

5. The air cooled turbine rotor blade of claim 1, and further comprising:

the trailing edge region cooling circuit includes a first and second metering and impingement holes and first and second impingement cavities connected to the third leg of the second aft flowing 3-pass serpentine flow cooling circuit.

6. The air cooled turbine rotor blade of claim 1, and further comprising:

the third leg of the first aft flowing 3-pass serpentine flow cooling circuit is connected to rows of film cooling holes on the pressure side wall and the suction side wall of the airfoil.

7. The air cooled turbine rotor blade of claim 1, and further comprising:

the blade tip channel is connected to tip cooling holes to discharge cooling air out from the blade tip.

8. The air cooled turbine rotor blade of claim 1, and further comprising:

all of the cooling air from the second aft flowing 3-pass serpentine flow cooling circuit flows from the first leg of the first aft flowing 3-pass serpentine flow cooling circuit.

9. The air cooled turbine rotor blade of claim 1, and further comprising:

the third leg of the second aft flowing 3-pass serpentine flow cooling circuit is connected to a blade tip corner channel;

the blade tip corner channel being connected to tip cooling holes to discharge cooling air through the blade tip corner.

10. The air cooled turbine rotor blade of claim 1, and further comprising:

a tip turn of the second leg of the first aft flowing 3-pass serpentine flow cooling circuit is located just below the blade tip channel such that the cooling air passing through the tip turn provides additional cooing to the blade tip channel.

11. A process for cooling a turbine rotor blade comprising the steps of:

supplying pressurized cooling air to a cooling air supply channel located adjacent to a leading edge region of the airfoil;

bleeding off a portion of the cooling air in the supply channel to provide impingement cooling for a backside surface of the leading edge wall of the airfoil;

discharging some of the spent impingement cooling air to provide a layer of film cooling air onto the external surface of the leading edge of the airfoil;

passing the remaining impingement cooling air to a trailing edge region cooling supply channel; and, passing most of the cooling air from the trailing edge region cooling supply channel through a series of impingement cooling holes to provide cooling for the trailing edge region of the airfoil.

12. The process for cooling a turbine rotor blade of claim 11, and further comprising the step of:

passing the remaining cooling air from the cooling supply channel that is not used for impingement cooling through a serpentine flow passages to cool a forward section of the airfoil.

13. The process for cooling a turbine rotor blade of claim 11, and further comprising the step of:

passing the cooling air from the impingement cavity through a blade tip channel to provide cooling for the blade tip.

14. The process for cooling a turbine rotor blade of claim 13, and further comprising the step of:

discharging some of the cooling air from the blade tip cooling channel through tip cooling holes before passing the remaining cooling air into the trailing edge region cooling supply channel.

15. The process for cooling a turbine rotor blade of claim 11, and further comprising the step of:

discharging the cooling air used for impingement cooling of the trailing edge region through a row of exit slots to provide cooling for the trailing edge.

16. The process for cooling a turbine rotor blade of claim 11, and further comprising the step of:

supplying the cooling air used for the entire blade through the cooling air supply channel.

* * * * *